US007350580B1

(12) United States Patent
Laureano

(10) Patent No.: US 7,350,580 B1
(45) Date of Patent: Apr. 1, 2008

(54) SUBSEA PASS THRU SWITCHING SYSTEM

(75) Inventor: Marcio Laureano, Østerås (NO)

(73) Assignee: Aker Kvaerner Subsea, Inc., Houston, TX (US)

( * ) Notice: Subject to any disclaimer, the term of this patent is extended or adjusted under 35 U.S.C. 154(b) by 125 days.

(21) Appl. No.: 11/188,400

(22) Filed: Jul. 25, 2005

Related U.S. Application Data

(60) Provisional application No. 60/598,649, filed on Aug. 4, 2004.

(51) Int. Cl.
*E21B 33/04* (2006.01)
*E21B 33/043* (2006.01)
*E21B 33/047* (2006.01)

(52) U.S. Cl. ..... 166/348; 166/344; 166/97.1; 285/123.1; 137/607; 251/149.6

(58) Field of Classification Search ..... 166/97.1, 166/348, 344, 368, 75.14, 332.1; 251/149.6; 137/607; 285/123.1, 123.3
See application file for complete search history.

(56) References Cited

U.S. PATENT DOCUMENTS 3,052,238 A * 9/1962 Broman et al. ..... 604/150
3,522,821 A * 8/1970 Komendera ..... 137/596
4,736,799 A * 4/1988 Ahlstone ..... 166/348
4,754,813 A * 7/1988 Jennings et al. ..... 166/344
4,969,519 A * 11/1990 Kelly ..... 166/348
5,941,574 A * 8/1999 Hamilton et al. ..... 285/3
6,050,338 A * 4/2000 Watkins ..... 166/348
6,082,460 A * 7/2000 June ..... 166/348
6,378,613 B1 * 4/2002 Kent et al. ..... 166/368
6,769,489 B2 * 8/2004 Dallas ..... 166/386
2004/0186420 A1 9/2004 June

* cited by examiner

*Primary Examiner*—Jennifer H. Gay
*Assistant Examiner*—Shane Bomar

(57) ABSTRACT

A coupling switches control fluid from a tubing hanger to a downhole completion of a subsea well. The coupling, located between a tubing hanging running tool and a downhole completion, includes a coupling body and a tubing hanger. A hydraulic poppet switches control fluid flow from a first and second flow path. The hydraulic poppet includes an isolation sleeve for opening and closing a first and second inlet port. At least two perimeter seals provide fluid isolation for the first flow path. A retainer seal seals the coupling body against the second inlet port. A retaining sleeve holds the coupling body against the tubing hanger. A first and second circumferential seal are located on opposite ends between the coupling body and tubing hanger. The hydraulic poppet is adapted to move perimeter seals and the retainer seal to open and close the first and second inlet ports.

12 Claims, 2 Drawing Sheets

SUBSEA PASS THRU SWITCHING SYSTEM

CROSS REFERENCE TO RELATED APPLICATIONS

The present application claims priority to U.S. Provisional Patent Application Ser. No. 60/598,649, filed Aug. 4, 2004 now abandoned.

FIELD

The present embodiments relate to subsea fluid couplers employing seals to switch fluid flow from a tubing hanger, which can be connected to a tubing hanger running tool, to completion equipment of a subsea well.

BACKGROUND

Subsea fluid couplers are commonly used in connection with subsea oil wells. Functions of the subsea well are controlled by valves and other devices which are actuated by hydraulic fluid. That fluid is delivered from the water surface through fluid supply conduits which are connected to the subsea well by means of underwater couplings. These couplings have been large and traditionally required many seals in order to provide effective fluid isolation. A need exists for a coupling with a smaller footprint than traditional couplings, that permits downhole functions to be accessible at all times and allows controlled transfer of communication between a tubing hanger running tool and a downhole completion equipment, or a workover unit, or a subsea well in production mode.

Within the oil industry, deep water completions require constant integrity checks due to possible damage to the inner wall of the well casing of the downhole hydraulic control lines due to bumping while running the completion downhole. Completion operations are lengthy and costly; therefore, a need exists for a means to discover a failure on the hydraulic control lines as soon as a failure occurs.

A need exists for a coupling, a system for use in tubing hangers, and a method for transferring fluid that meets all the above noted needs.

The present embodiments meet these needs.

SUMMARY

The embodied couplings are used to switch control fluid from a tubing hanger to a downhole completion of a subsea well. The coupling can be used in a system with a tubing hanger and in a method for transferring fluids from a first flow stream to a second flow stream. The coupling is made up of a coupling body with a sloped end connected to a tubing hanger. The coupling is located between a tubing hanger running tool and a downhole completion for a subsea well. A workover unit can be located where the downhole completion is for another embodiment. The coupling can be used for a production or injection well with installed tubing hanger.

The coupling has a hydraulic poppet for switching control fluid flow from a first flow path to a second flow path located within the coupling. This hydraulic poppet has an isolation sleeve operably connected to an actuator for opening and closing a first inlet port from the tubing hanger running tool. The actuator is engaged using a control element. The actuator also opens and closes a second inlet port from the tubing hanger.

Two or more perimeter seals are located between the actuator and the isolation sleeve for providing fluid isolation for the first flow path, and a retainer with a retainer seal is located on the sloped end of the coupling body for sealing the sloped end of the coupling body against the second inlet port.

A retaining sleeve holds the coupling body against the tubing hanger and a first circumferential seal, located between the coupling body and the tubing hanger on one end of the coupling body, and a second circumferential seal, located between the coupling body and the tubing hanger on the other end of the coupling body, are also used. The hydraulic poppet moves the perimeter seals to open and close the first inlet port as well as to move the retainer seal to open and close the second inlet port.

The coupling can be used in a tubing hanger system and in a method to control fluid flow into production or injection equipment, work over equipment, or completion equipment in a subsea well.

BRIEF DESCRIPTION OF THE DRAWINGS

The detailed description will be better understood in conjunction with the accompanying drawings, wherein like reference characters represent like elements, as follows.

Figure 1:
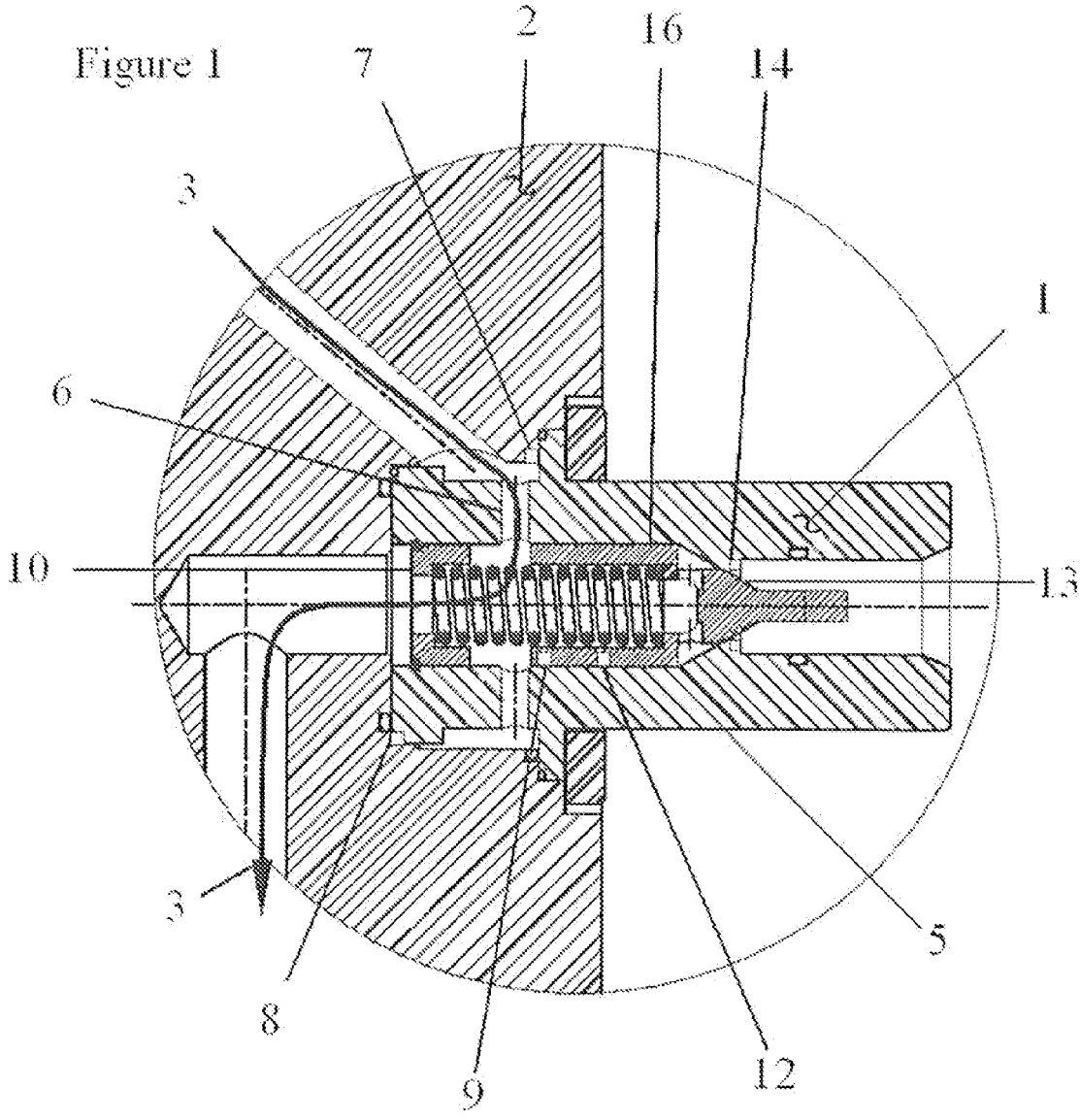
FIG. 1 depicts a side cross sectional view of an embodiment of the coupling in a first, open position.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that the embodiments can be practiced or carried out in various ways.

The embodied coupling incorporates a hydraulic switch that is a very small size. The coupling with the switch simultaneously monitors downhole lines during the running of a tubing hanger and controls fluid flow. The coupling allows switching from the vertical communication to the horizontal communication using a simple control element while running lines to workover equipment or to a subsea well in production mode. The coupling allows the controlled active transfer of communication.

With this device, horizontal communication is established when a hydraulic poppet in a coupling extends into a tubing hanger. Vertical communication is established when the poppet is retracted into the tubing hanger running position.

The embodied coupling requires a very small space in comparison to the known art and maintains switching capabilities from the horizontal penetration to a top to bottom. Since the switching is part of the coupling, additional holes are not needed in the operation. In addition, the operation is simplified by reducing the number of seals needed for increase reliability. The device allows active control of the switching mechanism.

The coupling allows the controlled switching of pressure control from two independent pressure sources. The switching action can be accomplished with the Tubing Hanger Running Tool (THRT) connected to the Tubing Hanger. Some systems currently available require disconnection of the THRT which negates the possibility of troubleshooting prior to tool retrieval.

The coupling permits switching back to and from one flow path to another under full BOP control and with the THRT connected to the Tubing Hanger. Switching flow paths is particularly useful for troubleshooting and systematic testing prior to retrieving the tool to the surface.

The coupling does not require additional assemblies to perform the switch. A hydraulic coupling is normally required to provide communication with downhole hydraulic lines during the production mode, when the tubing hanger is landed and locked within the Subsea Christmas Tree Spool body. The coupling concept is maintained even though the coupling relates to the use of the coupling as a three-way valve. The concept is achieved by the inclusion of only one set of seals, thereby maintaining the reliability of the system due to the reduced number of seals.

The couplings described herein are used to switch the flow of control fluid from a tubing hanger to a downhole completion of a subsea well. The coupling has a coupling body with a sloped end connected to a tubing hanger. The coupling is located between a tubing hanging running tool and a downhole completion equipment or work over equipment or production equipment. The coupling uses a hydraulic poppet to switch control fluid flow from a first flow path, typically a vertical flow path, in the tubing hanger to a second flow path. The second flow path is normally a horizontal communication.

The hydraulic poppet includes an isolation sleeve. An actuator is located with the isolation sleeve. The actuator opens and closes an inlet port. The inlet port receives the fluid from the first flow path. The actuator can be a spring, a piston, a remotely actuated device, or similar device that is operably connected to a control element. In addition to controlling a first inlet port, the actuator can open and close a second inlet port from the tubing hanger. Opening and closing the inlet ports can be performed sequentially or simultaneously. Two or more perimeter seals are positioned between the actuator and the coupling body. The seals provide fluid isolation for the first flow path.

A retainer with a retainer seal engages and seals the sloped end of the coupling body against the second inlet port to isolate fluid flow. A retaining sleeve holds the coupling body against the tubing hanger. A first circumferential seal is located between the coupling body and the tubing hanger on one end of the coupling body. A second circumferential seal is located between the coupling body and the tubing hanger on the other end of the coupling body. The hydraulic poppet is adapted to move the perimeter seals to open and close the first inlet port and to move the retainer seal to open and close the second inlet port.

Another benefit of the embodied coupling is the cost efficiency in implementing the solution. The hydraulic coupling has a small increase in cost which in turn is much lower than the impact of providing a separate three-way valve unit. Due to the sequence of operations, the switching can be done with full control from the completion vessel. For instance all control lines can be bled down from pressure to avoid seals being blown off from the coupling, during mating, due to the occurrence of explosive decompression.

Now with reference to the Figures, FIG. 1 depicts a cross sectional view of the coupling according to one embodiment. FIG. 1 depicts the coupling wherein the second port is open.

The first flow path (3) runs from a tubing hanger running tool (2) and well completion equipment. The tubing hanger running tool (2) and well completion equipment are shown in FIG. 1. A second flow path (4) runs from the tubing hanger (1) to the well completion equipment. Both flow paths pass through the coupling (5).

FIG. 1 depicts a preferred embodiment wherein the coupling (5) has an outer body that is generally cylindrical in a first end and a sloped, conical portion at a second end. Other shapes of the coupling's outer body can be used as to fit into a tubing hanger assembly. The body can be in the form of an isolation sleeve (16). The sloped side engages a retainer (13) that presses against a seal (14). A first inlet port (6) is in communication with the isolation sleeve (16) and the tubing hanger (1) for the first flow path (3). A second inlet port (18) is for the second flow path (4). A control element, such as a computer, can be used to engage and operate the actuator of the coupling.

An actuator (10) pushes against the retainer (13). FIG. 1 depicts the embodiment wherein the actuator (10) is a spring. The first and second circumferential seals (7) and (8) are located at opposite ends of the tubing hanger. Moveable perimeter seals (9) and (12) are located on the outside of the isolation sleeve (16). FIG. 1 depicts the embodiment of two perimeter seals, but three or more can be used depending on the size needed for the coupling. The circumferential seals (7) and (8) or the perimeter seals (9) and (12) seals can be elastomeric or rubber, metal-to-metal seals, or O-rings.

Figure 2:
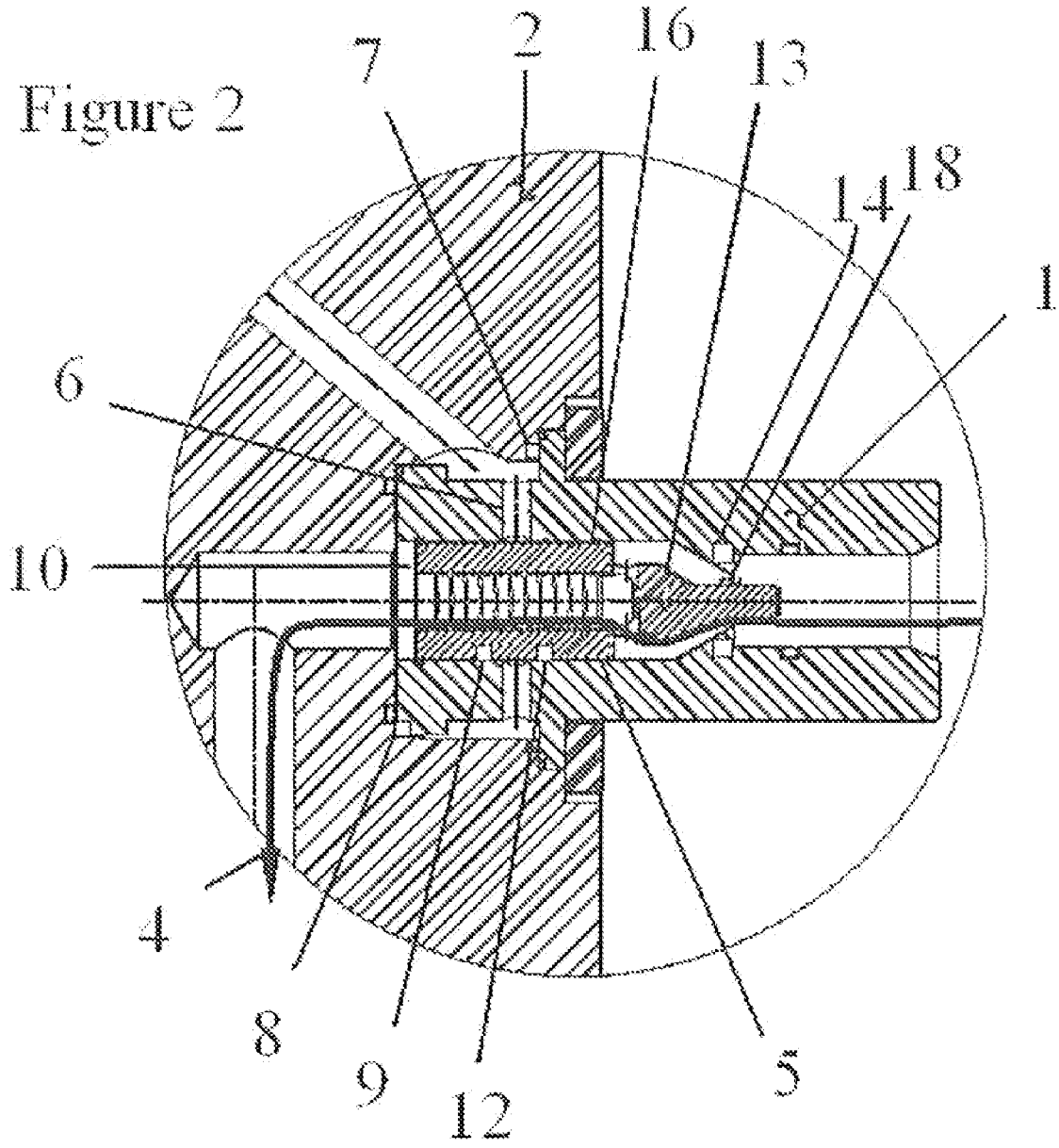
FIG. 2 depicts a side cross sectional view of an embodiment of the coupling in a second, closed position.

FIG. 2 is a cross sectional view of the coupling of FIG. 1 in the closed position. The coupling can be made from stainless steel or another sturdy metal capable of sustaining between 1500 and 20,000 psi in the flow paths and from external water pressure.

The coupling is typically used for switching control fluid paths during a down hole completion of a subsea well, as the following examples. At the surface, the lower end of the Tubing Hanger Running Tool (THRT) (2) is connected to the upper end of the tubing hanger (1) itself. When the THRT is connected to the tubing hanger, all hydraulic lines and the production bore of the tubing hanger are sealed from the respective porting on the lower end of the THRT. All downhole hydraulic lines are monitored through the upper end of the THRT. The upper end of the THRT is connected to a workover umbilical from which the lines are pressurized and monitored.

The tubing hanger and the attached THRT are lowered into the well through the marine riser until the tubing hanger's lower end lands within the Subsea Christmas Tree Spool body. The distance from the surface to the wellhead level is typically between 100 meters and 3,000 meters.

The tubing hanger is locked against the Subsea Christmas Tree Spool body. Next, the control from the workover umbilical is switched to a production control system located on the Subsea Christmas Tree Spool. The switch is achieved by extending the control element that opens the coupling mounted on the tubing hanger. The control element is located on the spool body. The coupling opens the flow path for the control fluid from the production control system and directs the flow path to the downhole functions. As this operation is performed, the flow path to the porting that communicates with the workover umbilical is sealed off. Control of the downhole function is now performed by the production control system.

Once the switching operation takes place, several tests are performed to ensure the integrity of the connection between the control element and the tubing hanger. The tests also verify that the production control system is accessing the downhole functions adequately. In the event that the pressure and communication integrity has not been established, troubleshooting procedures are initiated.

Integrity of the downhole function and verification that the production control system is operating can be verified by switching control back over to the workover umbilical. The control can be switched back by retracting the coupling. Retracting the coupling seals off the flow path to the production control system and opens the porting to the workover umbilical. Individual line testing can take place through the umbilical lines previously used for monitoring.

The present embodiments utilize a unique path flow that differs from the flow paths in the known art. The present embodiments utilize a sliding mechanism that opens and closes, wherein devices in the known art do not close. The present embodiments utilize a tapered poppet seal and do not require a rod.

While these embodiments have been described with emphasis on the preferred embodiments, it should be understood that within the scope of the appended claims, the embodiments might be practiced other than as specifically described herein.

What is claimed is:

1. A coupling for switching control fluid from a tubing hanger to a downhole completion of a subsea well, wherein the coupling comprises:

a. a coupling body comprising a sloped end connected to the tubing hanger, wherein the coupling body is located between a tubing hanger running tool and the downhole completion, wherein the coupling body further comprises:

a hydraulic poppet for switching control fluid flow from a first flow path to a second flow path, wherein the hydraulic poppet comprises an isolation sleeve containing an actuator, wherein the actuator opens and closes a first inlet port from the tubing hanger running tool using a control element, and wherein the actuator opens and closes a second inlet port from the tubing hanger;

b. at least two perimeter seals located between the tubing hanger and the coupling body, wherein the seals provide fluid isolation for the first flow path;

c. a retainer comprising a retainer seal for sealing the sloped end against the second inlet port;

d. a retaining sleeve for holding the coupling body against the tubing hanger;

e. a first circumferential seal located between the tubing hanger running tool and the tubing hanger on one end of the tubing hanger; and f. a second circumferential seal located between the tubing hanger running tool and the tubing hanger on the other end of the tubing hanger, wherein the hydraulic poppet is adapted to move the perimeter seals independent of the pressure of the fluid flow to open and close the first inlet port and move the retainer seal to open and close the second inlet port.

2. The coupling of claim 1, wherein the control element opens and closes the first inlet port simultaneously with the opening or closing of the second inlet port.

3. The coupling of claim 1, wherein the seals are metal-to-metal seals or resilient seals.

4. The coupling of claim 3, wherein the resilient seals are elastomeric material seals or rubber seals.

5. The coupling of claim 1, wherein at least one seal is an O-ring.

6. The coupling of claim 1 wherein the control element is an electrical actuator, a hydraulic actuator, a manual actuator, or an electro-hydraulic actuator operatively connected to the poppet.

7. The coupling of claim 1, wherein the coupling is adapted to support pressure ranging between 1500 psi and 20,000 psi in the first flow path, the second flow path, or combinations thereof.

8. The coupling of claim 1, wherein the actuator is a spring, a remotely actuated spring, a hydraulic piston, an electric motor, a remote electric sleeve, and combinations thereof.

9. The coupling of claim 1, wherein the coupling body and the retaining sleeve comprise steel.

10. A system usable with a subsea well and subsea equipment for completing the well for managing control fluids, wherein the system comprises:

a. a tubing hanger; and b. a coupling located in the tubing hanger, wherein the coupling is adapted to control deployment of subsea control fluids into subsea well completing equipment, wherein the coupling comprises:

i. a coupling body comprising a sloped end connected to the tubing hanger, wherein the coupling body is located between a tubing hanger running tool and a downhole completion, wherein the coupling body further comprises:

a hydraulic poppet for switching control fluid flow from a first flow path to a second flow path, wherein the hydraulic poppet comprises an isolation sleeve containing an actuator, wherein the actuator opens and closes a first inlet port from the tubing hanger running tool using a control element, and wherein the actuator opens and closes a second inlet port from the tubing hanger;

ii. at least two perimeter seals located between the tubing hanger and the coupling body, wherein the seals provide fluid isolation for the first flow path;

iii. a retainer comprising a retainer seal for sealing the sloped end against the second inlet port;

iv. a retaining sleeve for holding the coupling body against the tubing hanger;

v. a first circumferential seal located between the tubing hanger running tool and the tubing hanger on one end of the tubing hanger; and vi. a second circumferential seal located between the tubing hanger running tool and the tubing hanger on the other end of the tubing hanger, and wherein the hydraulic poppet is adapted to move the perimeter seals to open and close the first inlet port and move the retainer seal to open and close the second inlet port.

11. The system of claim 10, wherein the subsea equipment comprises a production tubing.

12. A coupling for switching control fluid from a tubing hanger to a downhole completion of a subsea well, wherein the coupling comprises:

a. a coupling body comprising a sloped end connected to the tubing hanger, wherein the coupling body is located between a tubing hanger running tool and the downhole completion, wherein the coupling body further comprises:

a hydraulic poppet for switching control fluid flow from a first flow path to a second flow path, wherein the hydraulic poppet comprises an isolation sleeve containing an actuator, wherein the actuator opens and closes a first inlet port from the tubing hanger running tool using an electrical control element, wherein the actuator opens and closes a second inlet port from the tubing hanger responsive to input from the electrical control element;

b. at least two perimeter seals located between the tubing hanger and the coupling body, wherein the seals provide fluid isolation for the first flow path;

c. a retainer comprising a retainer seal for sealing the sloped end against the second inlet port;

d. a retaining sleeve for holding the coupling body against the tubing hanger;

e. a first circumferential seal located between the tubing hanger running tool and the tubing hanger on one end of the tubing hanger; and f. a second circumferential seal located between the tubing hanger running tool and the tubing hanger on the other end of the tubing hanger, and wherein the hydraulic poppet is adapted to move the perimeter seals to open and close the first inlet port and move the retainer seal to open and close the second inlet port.

* * * * *